US007681661B2

(12) United States Patent
Sakai et al.

(10) Patent No.: US 7,681,661 B2
(45) Date of Patent: Mar. 23, 2010

(54) ELECTRIC POWER TOOL

(75) Inventors: Masato Sakai, Ibaraki (JP); Satoru Matsuno, Ibaraki (JP); Masanori Watanabe, Ibaraki (JP); Chikai Yoshimizu, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/262,949

(22) Filed: Nov. 1, 2005

(65) Prior Publication Data

US 2006/0048959 A1 Mar. 9, 2006

Related U.S. Application Data

(63) Continuation of application No. 10/320,515, filed on Dec. 17, 2002, now Pat. No. 7,108,079.

(30) Foreign Application Priority Data

Feb. 22, 2002 (JP) ..... P2002-046928

(51) Int. Cl.
*E21B 19/16* (2006.01)

(52) U.S. Cl. ..... 173/217

(58) Field of Classification Search ..... 173/216, 173/93.5, 97, 217, 122, DIG. 2, 205
See application file for complete search history.

(56) References Cited

U.S. PATENT DOCUMENTS

| | | | | |
|---|---|---|---|---|
| 1,115,704 | A | | 11/1914 | Manes |
| 2,207,269 | A | | 7/1940 | Schiff |
| 2,949,975 | A | | 8/1960 | Plummer |
| 3,363,699 | A | | 1/1968 | Maffey, Jr. |
| 3,481,411 | A | | 12/1969 | Wood |
| 3,554,316 | A | | 1/1971 | Judd et al. |
| 3,948,328 | A | | 4/1976 | Hiraoka et al. |
| 4,223,744 | A | * | 9/1980 | Lovingood ..... 173/48 |
| 4,428,438 | A | * | 1/1984 | Holzer ..... 173/48 |
| 4,477,213 | A | * | 10/1984 | Nelson et al. ..... 408/241 R |
| 4,624,339 | A | | 11/1986 | Marcel et al. |
| 4,791,833 | A | | 12/1988 | Sakai et al. |
| 4,932,294 | A | | 6/1990 | Chang |
| 4,981,247 | A | | 1/1991 | Noll |
| 5,006,740 | A | * | 4/1991 | Palm ..... 310/50 |
| 5,025,970 | A | | 6/1991 | Anderson et al. |

(Continued)

FOREIGN PATENT DOCUMENTS

CN 1026074 C 10/1994

(Continued)

OTHER PUBLICATIONS

English Translation of the German Office Action dated Nov. 25, 2003.

(Continued)

*Primary Examiner*—Brian D Nash
(74) *Attorney, Agent, or Firm*—McGinn IP Law Group PLLC

(57) ABSTRACT

A cover which covers outer peripheries of fastening screws are disposed on an outer periphery of a hammer case. A stopper which detachably positions and fixes the cover to the outer periphery of the hammer case is disposed.

16 Claims, 12 Drawing Sheets

U.S. PATENT DOCUMENTS

| | | | | |
|---|---|---|---|---|
| 5,149,230 | A * | 9/1992 | Nett | 408/42 |
| 5,361,853 | A | 11/1994 | Takamura et al. | |
| 5,418,339 | A | 5/1995 | Bowen et al. | |
| 5,550,416 | A | 8/1996 | Fanchang et al. | |
| 5,709,332 | A | 1/1998 | Coop | |
| 5,862,970 | A | 1/1999 | Cougar | |
| 5,897,454 | A | 4/1999 | Cannaliato | |
| 5,944,119 | A | 8/1999 | Hsieh | |
| 5,992,540 | A | 11/1999 | Smolinski et al. | |
| 6,059,166 | A | 5/2000 | Ho et al. | |
| 6,142,242 | A | 11/2000 | Okumura et al. | |
| 6,199,383 | B1 * | 3/2001 | Pusateri | 60/695 |
| 6,296,168 | B1 | 10/2001 | Hung | |
| 6,305,481 | B1 | 10/2001 | Yamazaki et al. | |
| 6,334,743 | B1 * | 1/2002 | Liao | 408/16 |
| 6,419,141 | B1 | 7/2002 | Wang | |
| 6,431,289 | B1 | 8/2002 | Potter et al. | |
| 6,431,429 | B1 | 8/2002 | Canlas et al. | |
| 6,523,267 | B1 | 2/2003 | Osada et al. | |
| 6,595,300 | B2 | 7/2003 | Milbourne | |
| 6,671,931 | B1 * | 1/2004 | Duncan | 16/435 |
| 6,688,407 | B2 * | 2/2004 | Etter et al. | 173/170 |
| 6,981,344 | B2 * | 1/2006 | Cahill et al. | 42/71.01 |
| 7,025,149 | B2 | 4/2006 | Pusateri et al. | |
| 2002/0035876 | A1 | 3/2002 | Donaldson | |
| 2003/0196824 | A1 | 10/2003 | Gass et al. | |

FOREIGN PATENT DOCUMENTS

| | | | |
|---|---|---|---|
| CN | 1300341 | A | 6/2001 |
| DE | 75 30 984 | U1 | 10/1975 |
| DE | 86 27 157 | U1 | 11/1986 |
| DE | 93 09 682 | U1 | 6/1993 |
| DE | 94 13 828 | U1 | 8/1994 |
| DE | 197 05 378 | C2 | 8/1997 |
| DE | 101 30 547 | A1 | 6/2001 |
| DE | 200 07 689 | U1 | 6/2001 |
| DE | 100 42 178 | C1 | 12/2001 |
| EP | 1 281 486 | A1 | 2/2003 |
| JP | 56-116171 | | 9/1981 |
| JP | 59-42872 | | 3/1984 |
| JP | 62-124883 | | 6/1987 |
| JP | 64-16383 | | 1/1989 |
| JP | 01-99578 | | 7/1989 |
| JP | 5-85579 | | 11/1993 |
| JP | 6-85777 | | 12/1994 |
| JP | 7-328958 | | 12/1995 |
| JP | 8-281572 | | 10/1996 |
| JP | 9-109044 | | 4/1997 |
| JP | 9-141560 | | 6/1997 |
| JP | 10-315154 | | 12/1998 |
| JP | 2001-179661 | | 7/2001 |
| JP | 2001-269874 | | 10/2001 |
| JP | 2001-300861 | | 10/2001 |
| JP | 2003-245865 | | 9/2003 |
| WO | WO 01/58628 | A1 | 8/2001 |

OTHER PUBLICATIONS

German Office Action dated Dec. 21, 2005, with English translation.
Chinese Office Action dated Mar. 23, 2007, with an English translation.
Applicant's Request for Accelerated Examination dated Oct. 25, 2004, with English Translation.
Japanese Office Action dated Jan. 18, 2005, with English translation.
Japanese Office Action dated Feb. 22, 2008, with English translation.
Japanese Office Action dated Mar. 21, 2008, with English translation.
Japanese Office Action dated Nov. 6, 2008, with English translation.
Chinese Office Action (Fourth) issued in Chinese Patent Application No. 2006101006313.6, Aug. 7, 2009 (English Translation).

* cited by examiner

[RELATED ART] FIG. 17
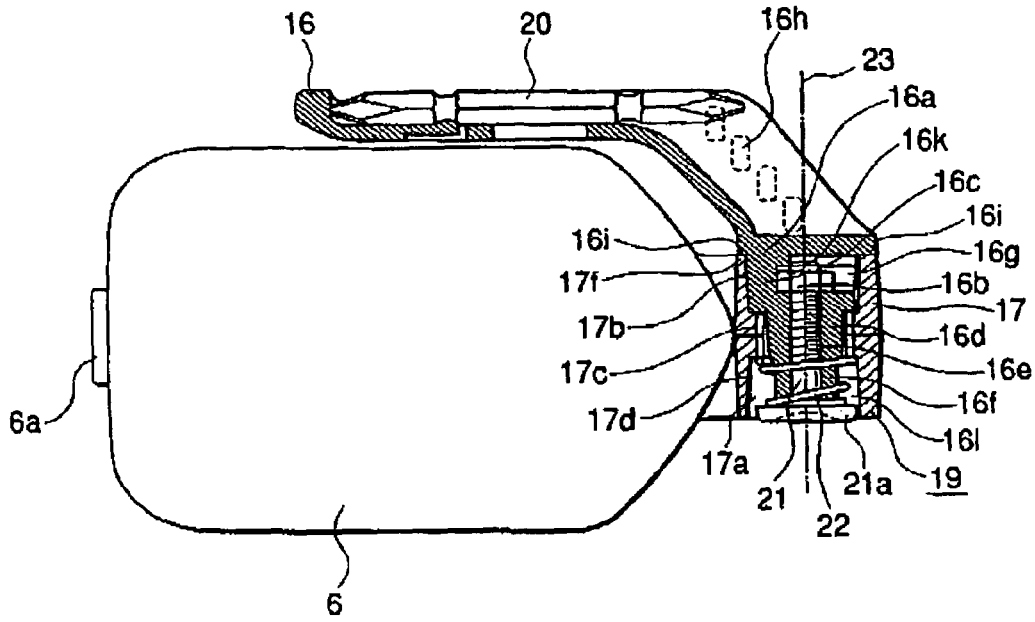
[RELATED ART] FIG. 18
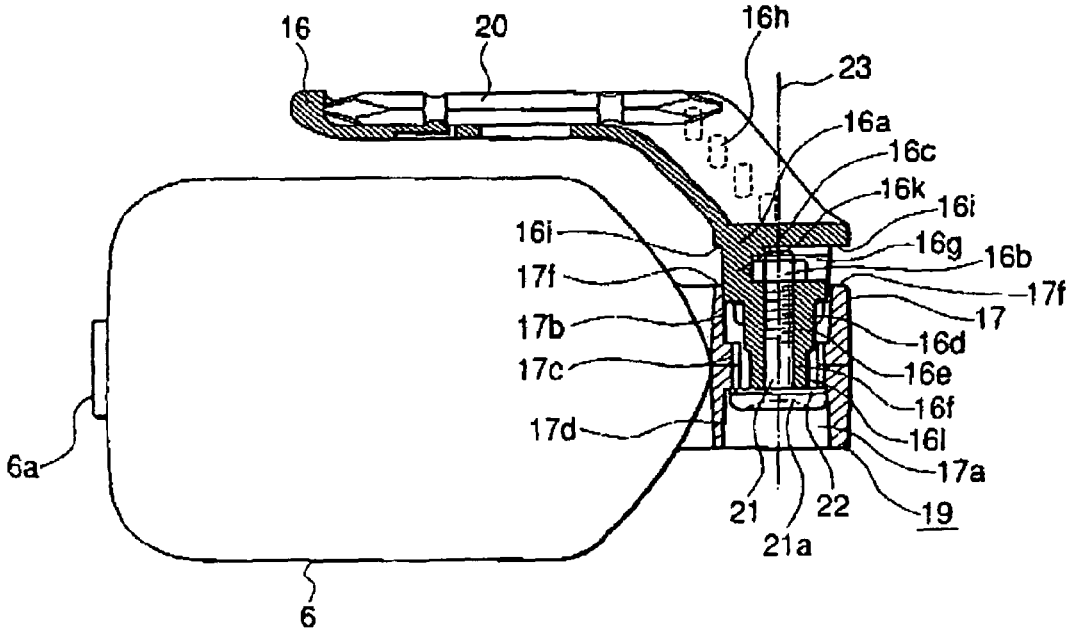

ELECTRIC POWER TOOL

The present application is a Continuation Application of U.S. patent application Ser. No. 10/320,515 filed on Dec. 17, 2002, which has issued as U.S. Pat. No. 7,108,079.

BACKGROUND OF THE INVENTION

1. Field of the Invention

The present invention relates to an electric power tool having a hook portion which can be hooked to a waist belt or the like of a worker, such as an impact driver/impact wrench.

2. Description of the Related Art

A conventional electric power tool (impact driver/impact wrench) will be described with reference to FIGS. 13 to 19. FIG. 13 is a side view showing a conventional electric power tool, FIG. 14 is a side view, partly in longitudinal section, showing the conventional electric power tool, FIG. 15 is a side view, partly omitted, of a hook portion of the conventional electric power tool as looking from the right side of FIG. 14, FIG. 16 is a fragmentary section view of the conventional electric power tool as looking from a battery side of FIG. 14, FIG. 17 is a section view of the conventional electric power tool and showing a locked state of a hook as looking from the battery side, FIG. 18 is a section view of the conventional electric power tool and showing an unlocked state of the hook as looking from the battery side, and FIG. 19 is a diagram showing a use state of the conventional electric power tool.

Referring to FIGS. 13 to 18, the electric power tool has an outer frame configured by a two-piece housing 1, a hammer case 2, and so forth, and is formed into an approximately T-like shape. A body portion 1*a* formed by the housing 1 houses a motor 3 serving as a driving source, a reduction mechanism 4, etc. A handle 1*b* which hangs from the body portion 1*a* houses a trigger switch 5, and contacts (not shown) which are to be electrically connected to terminals of a storage battery 6. The hammer case 2 is placed adjacent to the housing 1, and houses: a percussion mechanism 7 which converts the rotative power from the motor 3 into a percussive force; and a holder 8 for a tool bit such as a bit or a wrench which is not shown. According to the configuration, the rotative power from the motor 3 is transmitted to the reduction mechanism 4 from a pinion 3*a* which is an output shaft of the motor 3, and then to the tool bit from the reduction mechanism 4 via the percussion mechanism 7.

The reduction mechanism 4 is configured by: a stationary-gear support jig 4*a* which is supported in the housing 1, and which has a rotation stop; a stationary gear 4*b*; planetary gears 4*c*; a spindle 9; and needle pins 4*d* serving as rotation shafts of the planetary gears 4*c* and supported on the spindle 9. The percussion mechanism 7 is configured by: the spindle 9; a hammer 11 which are made rotatable and movable along the axis of the rotation shaft via steel balls 10 that are inserted into a cam groove 9*a* formed in the spindle 9; an anvil 12 having anvil claws 12*a* which are struck by a plurality of hammer claws 11*a* disposed on the hammer 11 to be rotated; and a spring 13 which always urges the hammer 11 toward the anvil 12.

In the thus configured electric power tool, an impulsive impact which is to be applied to a screw, a nut, or the like that is to be tightened by the tool bit is generated in the following manner. The trigger switch 5 is operated to supply an electric power to the motor 3, thereby rotating the motor 3. Thereafter, the rotative power from the motor 3 is transmitted to the planetary gears 4*c* via the pinion 3*a* which is coupled to the front end of the motor 3, and the rotative power from the pinion 3*a* is transmitted to the spindle 9 via the needle pins 4*d* by means of meshing between the planetary gears 4*c* and the stationary gear 4*b*. The turning force of the spindle 9 is transmitted to the hammer 11 via the steel balls 10 which are arranged between the cam groove 9*a* of the spindle 9 and a cam groove 11*b* of the hammer 11. The hammer claws 11*a* of the hammer 11 which is urged to the front side (toward the bit) by the spring 13 placed between the hammer 11 and the planetary gears 4*c* of the spindle 9 are caused to strike the anvil claws 12*a* of the anvil 12 by the rotation, so that the impact is generated. When the striking energy of the hammer 11 is reduced after the striking and the torque of the anvil 12 is reduced, the hammer 11 is repelled from the anvil 12, and hence the hammer 11 moves (retracts) along the cam groove toward the planetary gears 4*c*. Thereafter, the hammer 11 is pushed back toward the anvil 12 along the cam groove by the compressive force of the spring 13, and the hammer claws 11*a* again strike the anvil claws 12*a* by the rotation of the spindle 9. In this way, a continuous impact torque is applied to the tool bit such as a bit or a wrench by repeatedly conducting the striking against the anvil claws 12*a* by the axial movement and rotation of the hammer 11, so that a work of fastening a screw or a nut onto a work member 14, or that of loosening a screw or a nut from the work member 14 can be conducted.

An elastomer 15 is applied by two-layer molding to the surface of the housing 1 of the electric power tool having the percussion mechanism 7 and the reduction mechanism 4 which have been described above, specifically, on the rear face of the body portion 1*a* of the housing 1 and the handle 1*b*. The purposes of application of the elastomer 15 are to improve an antislipping function of surely gripping the electric power tool or a grip feeling, thereby enhancing the operability and the workability, to absorb an impact when the electric power tool is dropped on the ground, thereby preventing the tool from being damaged, and to, when the electric power tool is placed on an inclined face, prevent the tool from slipping down along the inclination. In order to enhance the effects of preventing the electric power tool from being damaged and of antislipping, the elastomer 15 may be applied to the periphery of a battery holder 1*c*.

As shown in FIGS. 13 to 18, in order to enable the body of the electric power tool to be hooked to a waist belt or the like of a worker, the electric power tool is provided with a rotatable hook-portion 19 configured by an engagement member 16, a holding portion 17, and a strap portion 18 which will be described below.

The hook portion 19 comprises: the engagement member 16 which can house a tool bit 20 such as a bit, and which has a substantially cylindrical basal end 16*a* made of a resin; the holding portion 17 which has a through hole 17*a* that can house the basal end 16*a* of the engagement member 16, and which extends from the handle 1*b* to a position adjacent to a side face of the storage battery 6; a bolt 21 serving as a fixing member which is passed through the holding portion 17, and which is screwed with a nut 16*b* serving as a locking member disposed in the basal end 16*a*, to prevent the engagement member 16 from slipping off from the holding portion 17; and an elastic member 22 formed by a spring or elastic rubber which urges the engagement member 16 in a direction along which the engagement member is locked to a nonrotatable position. In the basal end 16*a* of the engagement member 16 having a substantially L-like shape, disposed are: a cylindrical rotation tube 16*c* which uses a pivotal axis 23 as a rotation axis; an angle adjusting gear 16*d* which is formed on the rotation tube 16*c*, which protrudes in the direction of the pivotal axis 23, and which has a plurality of teeth that project radially outward with respect to the pivotal axis 23; a first ring portion 16*e* which protrudes so as to have a diameter that is substantially equal to the inner diameter of the angle adjusting gear 16*d*; and a second ring portion 16*f* having a diameter that is equal to or smaller than the outer diameter of the first ring portion 16*e*. In the basal end 16*a*, a nut housing portion 16*g* which has a half-hexagonal wall shape, and which non-rotatably houses the nut 16*b* that is to be screwed with the bolt 21 passed into the basal end from the side of the second ring portion 16*f* is disposed, and the through hole (bolt hole) 17*a* for housing the bolt 21 is disposed in the direction of the pivotal axis 23 in the range from the nut housing portion 16*g* to the second ring portion 16*f*. A step portion 16*i* for forming an outer diameter which is larger than the outer diameter of the rotation tube 16*c* is disposed on the end face of the rotation tube 16*c* which is positioned on the side opposite to the angle adjusting gear 16*d*, i.e., a rising protruding portion of the rotation tube 16*c* in the engagement member 16 having an antislipping portion 16*h*. A rotation inhibiting plate 16*j* which restricts the turning range of the engagement member 16 protrudes from the outer periphery of the rotation tube 16*c*.

On the other hand, the holding portion 17 is symmetrical about the split plane of the housing 1, and has the through hole (cylindrical hole) 17*a* in which the basal end 16*a* is to be housed. The through hole 17*a* is configured by: a rotation support hole 17*b* which houses the rotation tube 16*c*; a ring gear 17*c* which has a plurality of teeth, and which can mesh with the angle adjusting gear 16*d*; and a receiving hole 17*d* which houses a hooking spring 22 disposed between the ring gear 17*c* and the bolt 21 having a slotted head (bolt head) 21*a*, and the bolt head 21*a*. A rotation inhibiting plate receiving groove 17*e* which abuts against the rotation inhibiting plate 16*j* in order to restrict the turning range of the engagement member 16 to a predetermined angle range is formed in the rotation support hole 17*b*.

The strap portion 18 is disposed above the holding portion 17 and configured by: a strap screw 18*a* which is in parallel to the axial length of the basal end 16*a* that is passed through the through hole 17*a*; a through hole 18*b* through which the strap screw 18*a* is to be passed; and a strap nut 18*c* which is to be screwed with the strap screw 18*a* so as to prevent the strap screw 18*a* from slipping off from the through hole 18*b*. A cutaway portion 18*d* through which the strap screw 18*a* is exposed is formed in a part of the strap portion 18. A ring portion 18*f* which is formed in one end of a strap 18*e* is passed through the cutaway portion 18*d*. Thereafter, the strap screw 18*a* is passed into the ring portion 18*f* and then screwed with the strap nut 18*c*, thereby enabling the strap 18*e* to be hooked on the shaft of the strap screw 18*a*. Since the strap portion 18 is disposed above the holding portion 17 as described above, the engagement member 16 which is detachably disposed on the holding portion 17 is placed adjacent to a side wall of the storage battery 6.

Next, the methods of attaching and detaching the engagement member 16 to and from the holding portion 17 of the housing 1 will be described. In the state where the nut 16*b* is inserted into the nut housing portion 16*g*, first, the engagement member 16 is passed through the through hole 17*a* of the holding portion 17, the hooking spring 22 is passed into the receiving hole 17*d* along the second ring portion 16*f*, and a thread portion 21*b* disposed on the front end of the bolt 21 is screwed with a thread portion 16*k* formed inside the nut 16*b*, whereby the engagement member 16 can be attached to the holding portion 17 via the hooking spring 22. The engagement member 16 can be easily detached from the holding portion 17 of the housing 1 by conducting the above-mentioned procedure in the reverse sequence. As described above, the holding portion 17 is symmetrical about the split plane of the housing 1, and the engagement member 16 which can house the tool bit 20 such as a bit has a substantially linear shape. In accordance with, for example, the handedness of the worker, therefore, the engagement member 16 can be inserted into and attached to either of the right and left sides of the holding portion 17, to be used without causing any difficulty.

Next, an operation of turning the engagement member 16 will be described with reference to FIGS. 13 to 18. FIGS. 13 to 18 show a state where the engagement member 16 is positioned and fixed in a position adjacent to the side face of the storage battery 6. The engagement member 16 is configured so that the pressure of the hooking spring 22 is applied in the direction of pushing out the bolt head 21*a* with using a spring receiving end face 16*l* in the holding portion as a fulcrum, and the step portion 16*i* is supported with abutting against an end face 17*f* of the holding portion 17, whereby the member is prevented from being separated, and also that the angle adjusting gear 16*d* is held in the meshing state with the ring gear 17*c*, and hence the pivotal axis 23 of the basal end 16*a* is prevented from being rotated in the circumferential direction, whereby stabilized positioning and fixation can be attained. The position where the engagement member 16 is positioned adjacent to the vicinity of the side face of the storage battery 6 is one of positions where the end face of the rotation inhibiting plate 16*j* abuts against that of the rotation inhibiting plate receiving groove 17*e*. Therefore, the engagement member 16 can be turned to the position.

In this state, the engagement member 16 is turned in the following manner. As shown in FIGS. 13 to 18, when the antislipping portion 16*h* of the engagement member 16 is nipped by the fingers and then pulled in the direction of the pivotal axis 23 (the upward direction in the figure), the meshing between the angle adjusting gear 16*d* of the basal end 16*a* and the ring gear 17*c* is cancelled. Therefore, the engagement member 16 can be turned within the predetermined angle range. When the engagement member 16 is released at an arbitrary position, the angle adjusting gear 16*d* and the ring gear 17*c* are caused to mesh with each other by the elastic force of the hooking spring 22, and the engagement member can be positioned and fixed.

As described above, the hammer case which houses the percussion mechanism for converting the rotational power from the motor 3 into a percussive force, the holder for a tool bit such as a bit or a wrench that is not shown, and the like constitutes together with the housing the appearance of the electric power tool as shown in FIGS. 13 to 19. The hammer case abuts against the housing and is attached thereto by fastening screws. The heads of the fastening screws are exposed in the same manner as the hammer case. In the case where a work of fastening a screw is conducted in a corner as shown in FIG. 19, therefore, the heads of the fastening screws are in contact with the work member, thereby causing a problem in that the work member is damaged. Since the heads of the fastening screws are exposed in a projecting state, the heads are in contact with another member when the electric power tool is carried, thereby causing another problem in that the member is similarly damaged.

Depending on the kind of a work, the user sometimes conducts the work while gripping the outer periphery of the hammer case. In such a case, when the hammer case is heated by the heat which is generated during a process of striking the anvil claws by the hammer claws, it is difficult to grip the hammer case, thereby causing a further problem in that the workability and the operability are lowered.

In the case where a hammer case made of aluminum is gripped, when the hands of the user are wet with perspiration or water, slippage easily occurs to cause a further problem in that a work cannot be stably conducted.

Since coating is applied to the hammer case in order to prevent corrosion from occurring and improve the appearance, there is a further problem in that the coating work increases the cost and requires much labor.

SUMMARY OF THE INVENTION

It is an object of the invention to provide an electric power tool which can solve the problems, which can prevent a work member from being damaged, which is excellent in workability and operability, and which is economical.

The object can be accomplished by an electric power tool comprising: a motor serving as a driving source; a reduction mechanism which transmits rotative power from the motor; a percussion mechanism which converts the rotative power from the reduction mechanism into a percussive force; a hammer case which houses the percussion mechanism, the hammer case being made of metal; a housing which is adjacent to the hammer case, and which houses the motor; and fastening screws for disposing the hammer case on the housing, wherein a cover which covers outer peripheries of the fastening screws is disposed on an outer periphery of the hammer case.

BRIEF DESCRIPTION OF THE DRAWINGS

FIG. 17 is a section view showing a locked state of a hook as looking the conventional electric power tool from the battery side.

FIG. 18 is a section view showing an unlocked state of the hook as looking the conventional electric power tool from the battery side.

DETAILED DESCRIPTION OF THE PREFERRED EMBODIMENTS

Figure 1:
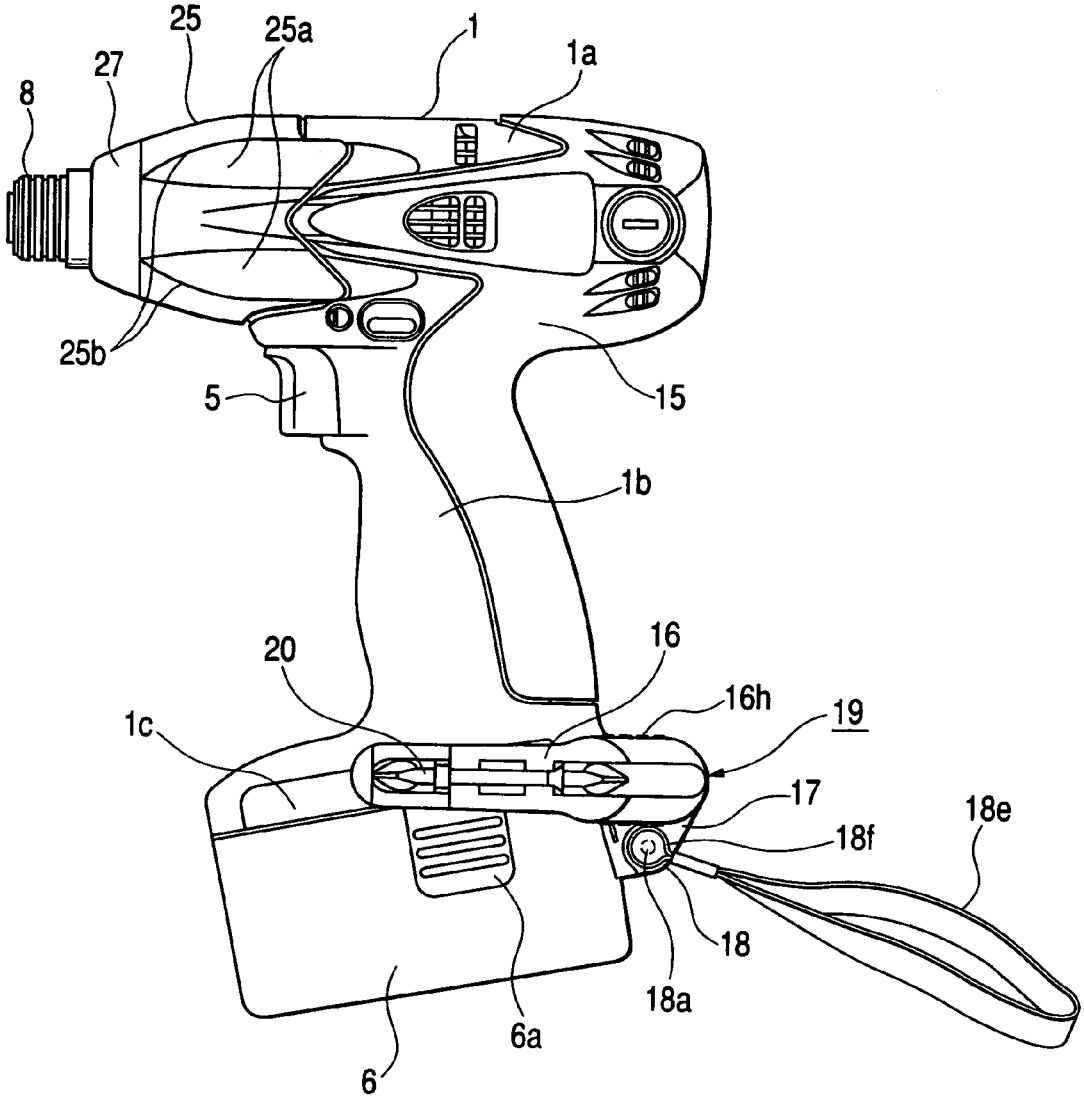
FIG. 1 is a side view showing the electric power tool of the invention.
Figure 3:
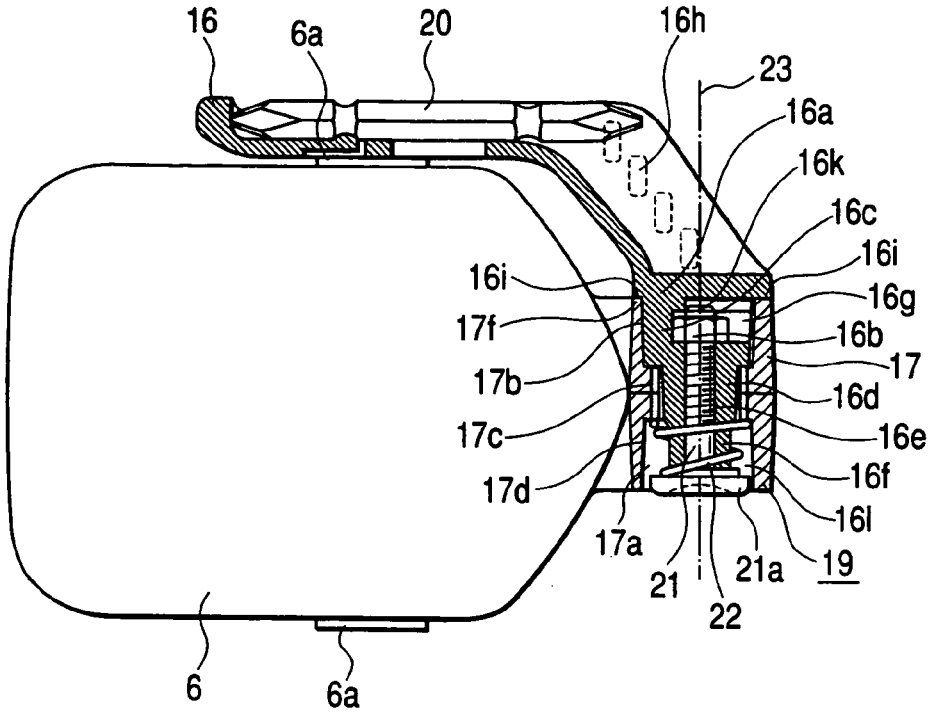
FIG. 3 is a section view showing a locked state of a hook as looking the electric power tool of the invention from the side of a storage battery.
Figure 4:
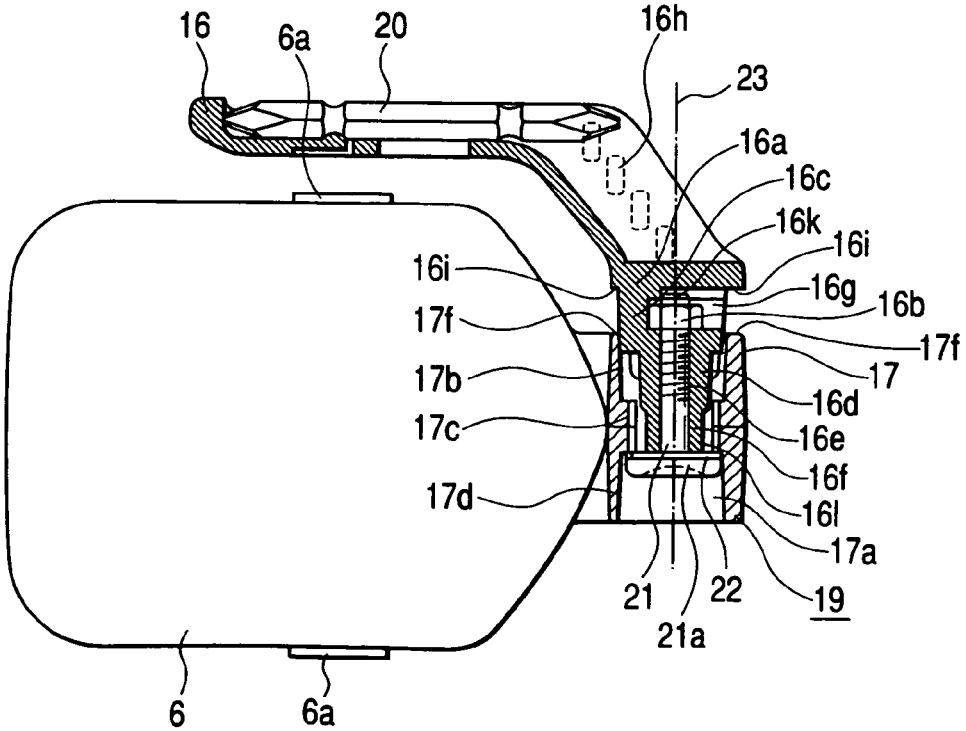
FIG. 4 is a section view showing an unlocked state of the hook as looking the electric power tool of the invention from the side of the storage battery.
Figure 5:
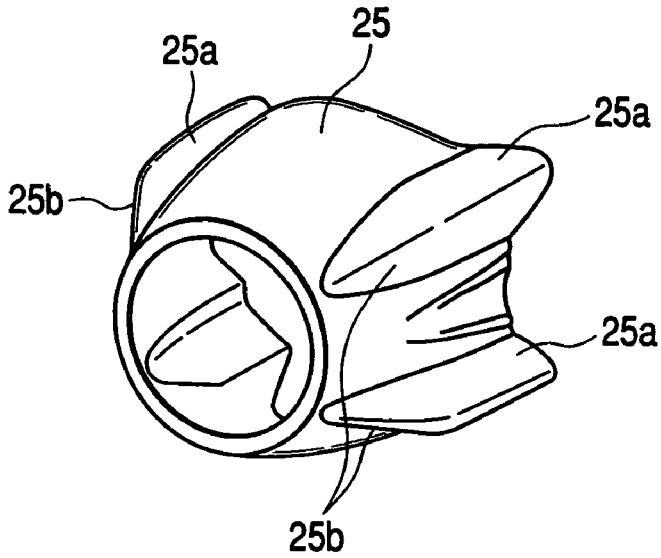
FIG. 5 is an external perspective view showing a cover which is disposed in the vicinity of a hammer case of the electric power tool of the invention.
Figure 6:
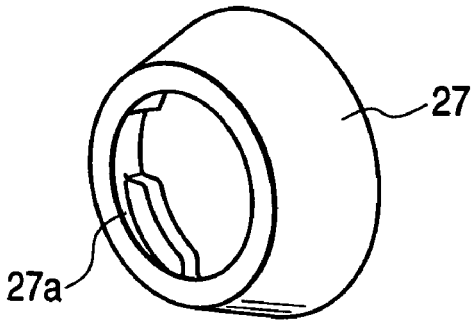
FIG. 6 is an external perspective view showing a stopper which positions and fixes the cover disposed on the electric power tool of the invention.
Figure 7:
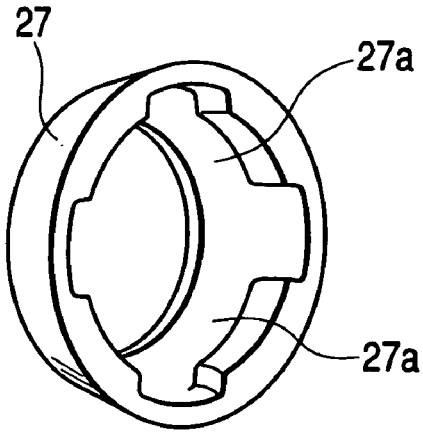
FIG. 7 is an external perspective view showing the inner side of the stopper shown in FIG. 6.
Figure 8:
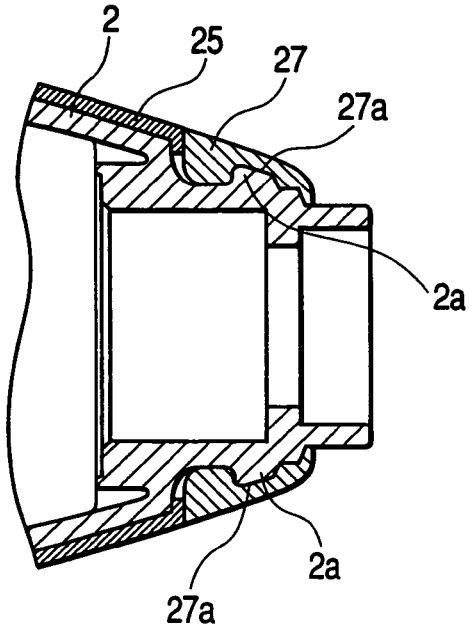
FIG. 8 is an enlarged longitudinal sectional side view of main portions and showing a state where the cover is disposed on the electric power tool of the invention and the cover is positioned and fixed by the stopper.
Figure 9:
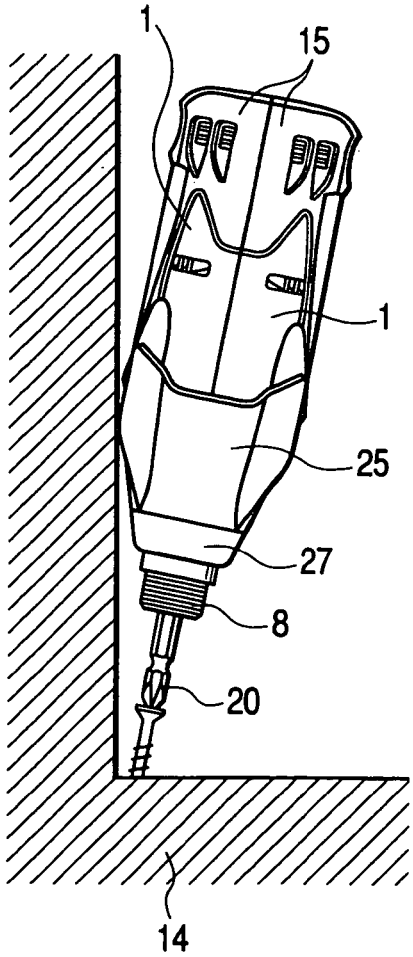
FIG. 9 is a diagram showing a use state of the electric power tool of the invention.
Figure 10:
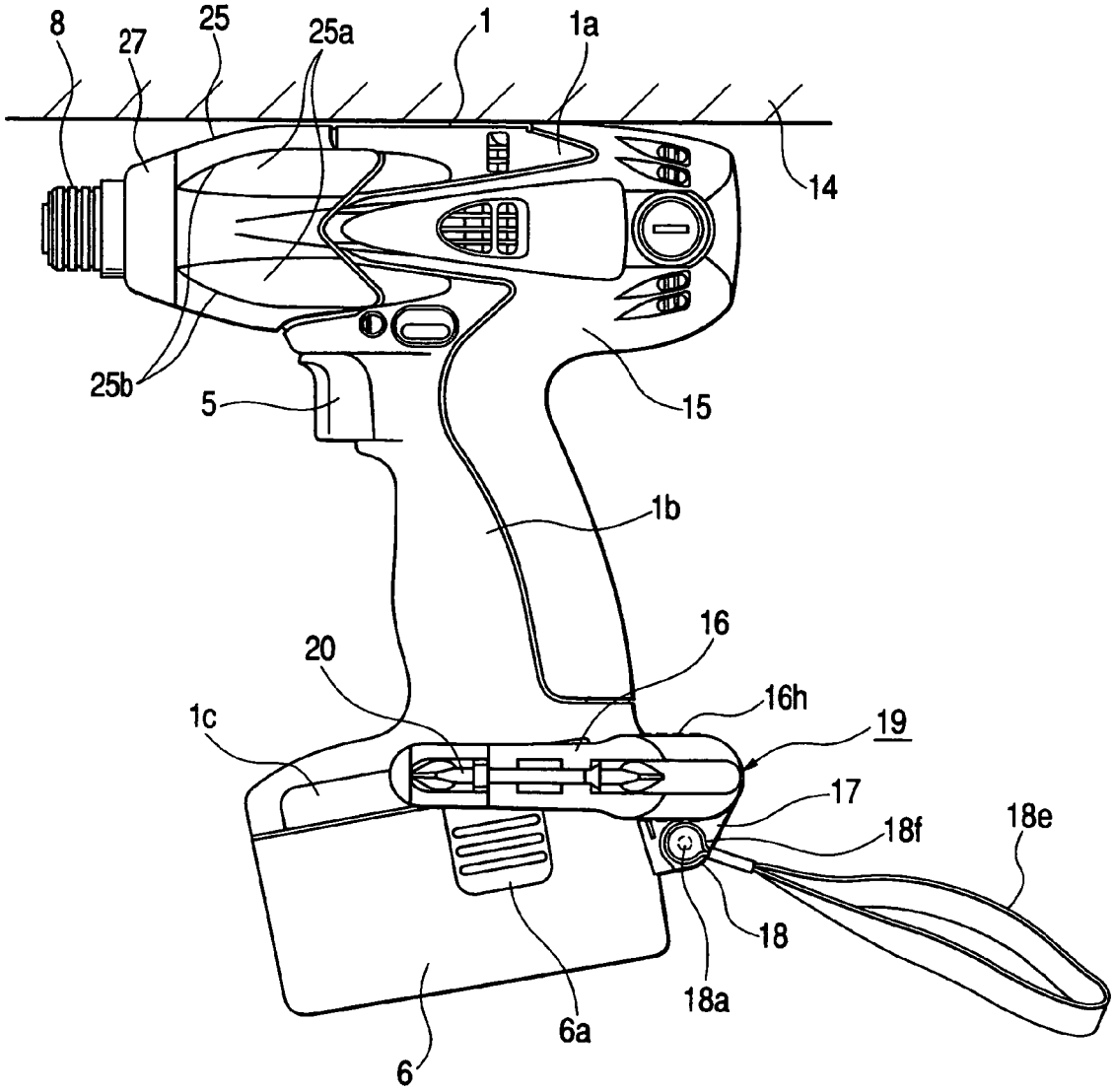
FIG. 10 is a diagram showing another use state of the electric power tool of the invention.
Figure 11A:
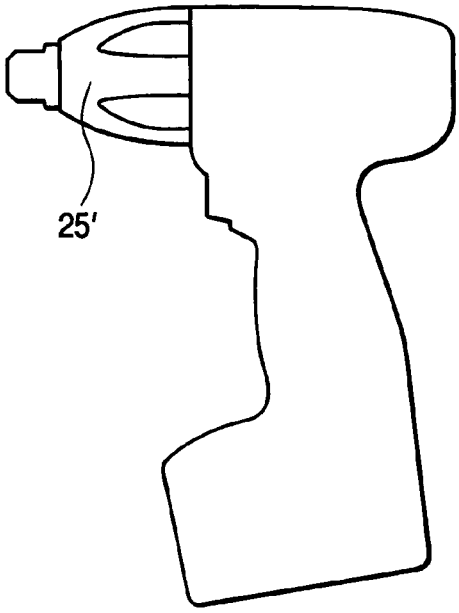
FIGS. 11A and 11B are a front view and a plan view showing a state where another cover according to the invention is attached to an electric power tool.
Figure 11B:
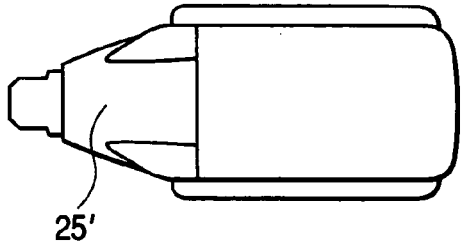
Figure 12A:
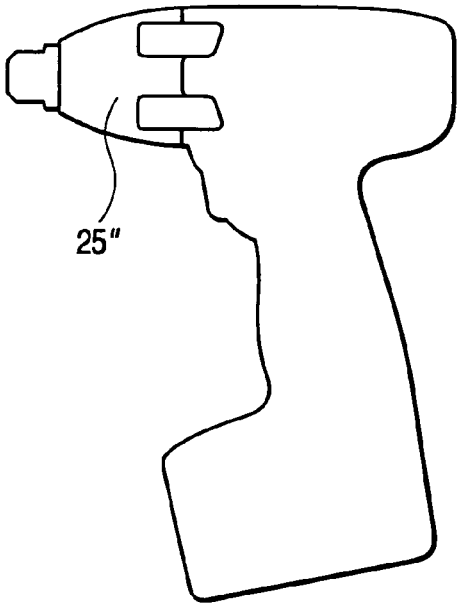
FIGS. 12A and 12B are a front view and a plan view showing a state where a further cover according to the invention is attached to an electric power tool.
Figure 12B:
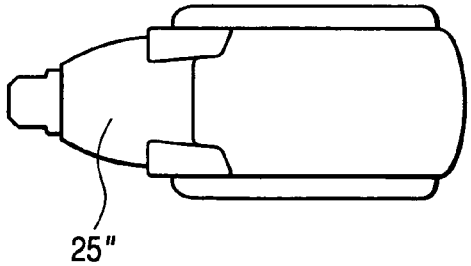
Figure 13:
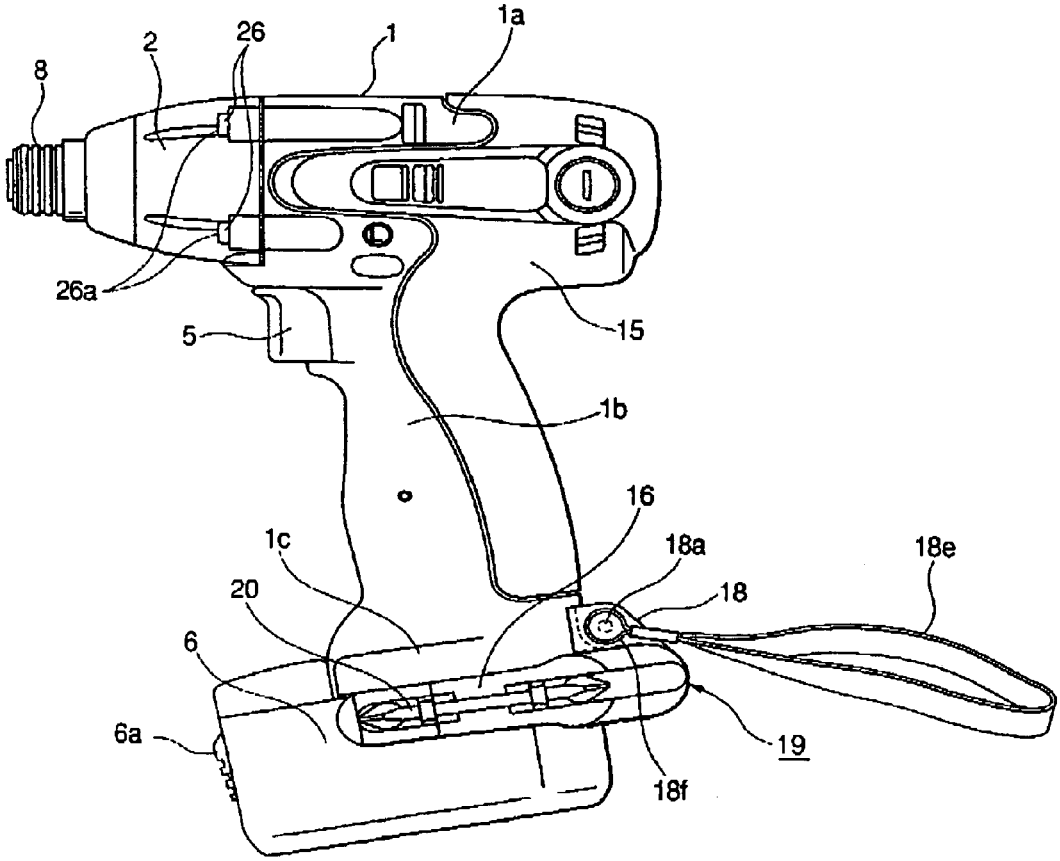
[RELATED ART] FIG. 13
FIG. 13 is a side view showing a conventional electric power tool.
Figure 14:
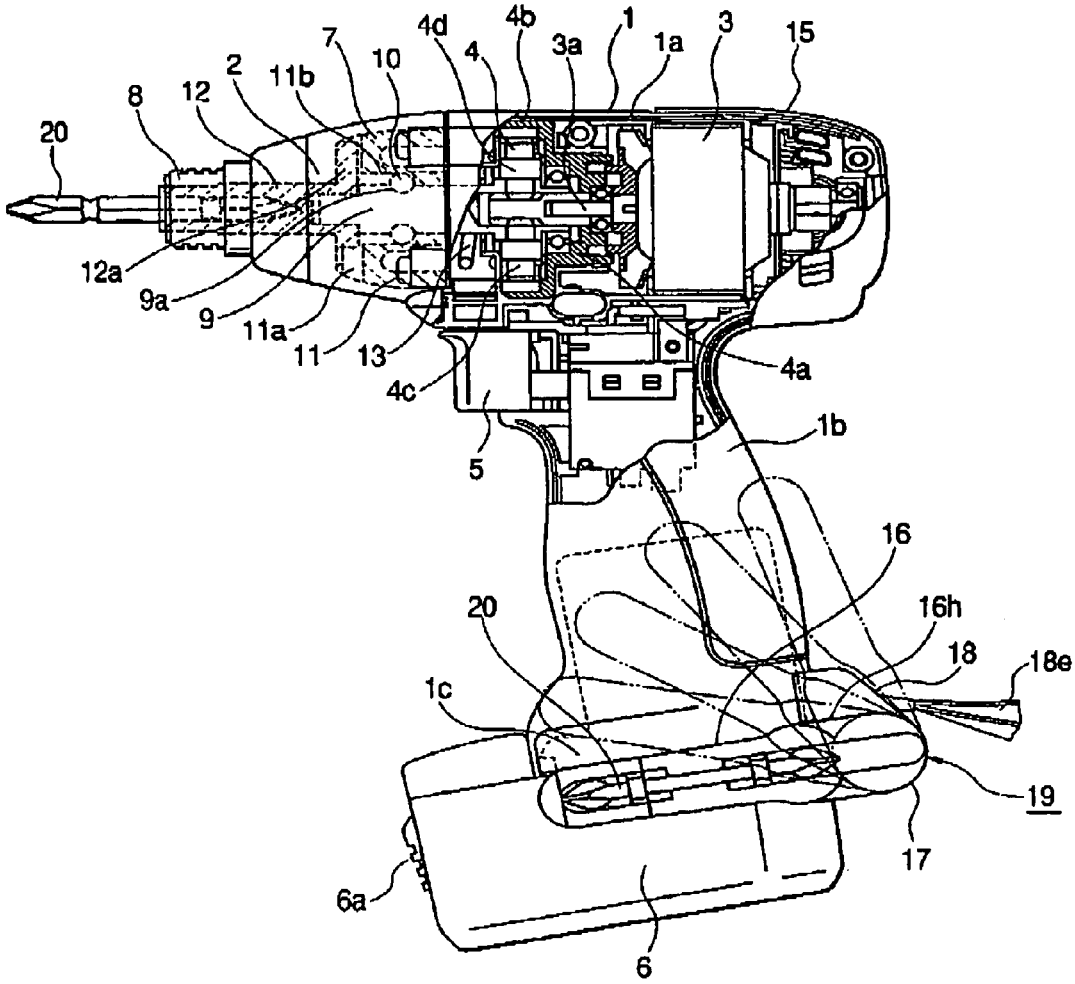
[RELATED ART] FIG. 14
FIG. 14 is a side view, partly in longitudinal section, showing the conventional electric power tool.

Hereinafter, an electric power tool (impact driver/impact wrench) of an embodiment will be described with reference to FIGS. 1 to 12. FIG. 1 is a side view showing the electric power tool of the embodiment, FIG. 2 is a side view, partly in longitudinal section, showing the electric power tool of the embodiment, FIG. 3 is a section view showing a locked state of an engagement member 16 as looking the electric power tool of the embodiment from the side of a storage battery 6, FIG. 4 is a section view showing an unlocked state of the engagement member 16 as looking the electric power tool of the embodiment from the side of the storage battery, FIG. 5 is an external perspective view showing a cover 25 which is disposed in the vicinity of a hammer case 2 of the electric power tool of the embodiment, FIG. 6 is an external perspective view showing a stopper 27 which positions and fixes the cover 25 disposed on the electric power tool, FIG. 7 is an external perspective view showing the inner side of the stopper 27 shown in FIG. 6, FIG. 8 is an enlarged longitudinal sectional side view of main portions and showing a state where the cover 25 is disposed on the electric power tool of the embodiment and the cover 25 is positioned and fixed by the stopper 27, FIG. 9 is a diagram showing a use state of the electric power tool of the embodiment, FIG. 10 is a diagram showing another use state of the electric power tool of the embodiment, FIG. 11 is an external perspective view showing another cover 25' in the embodiment, and FIG. 12 is an external perspective view showing a further cover 25" in the embodiment.

Figure 2:
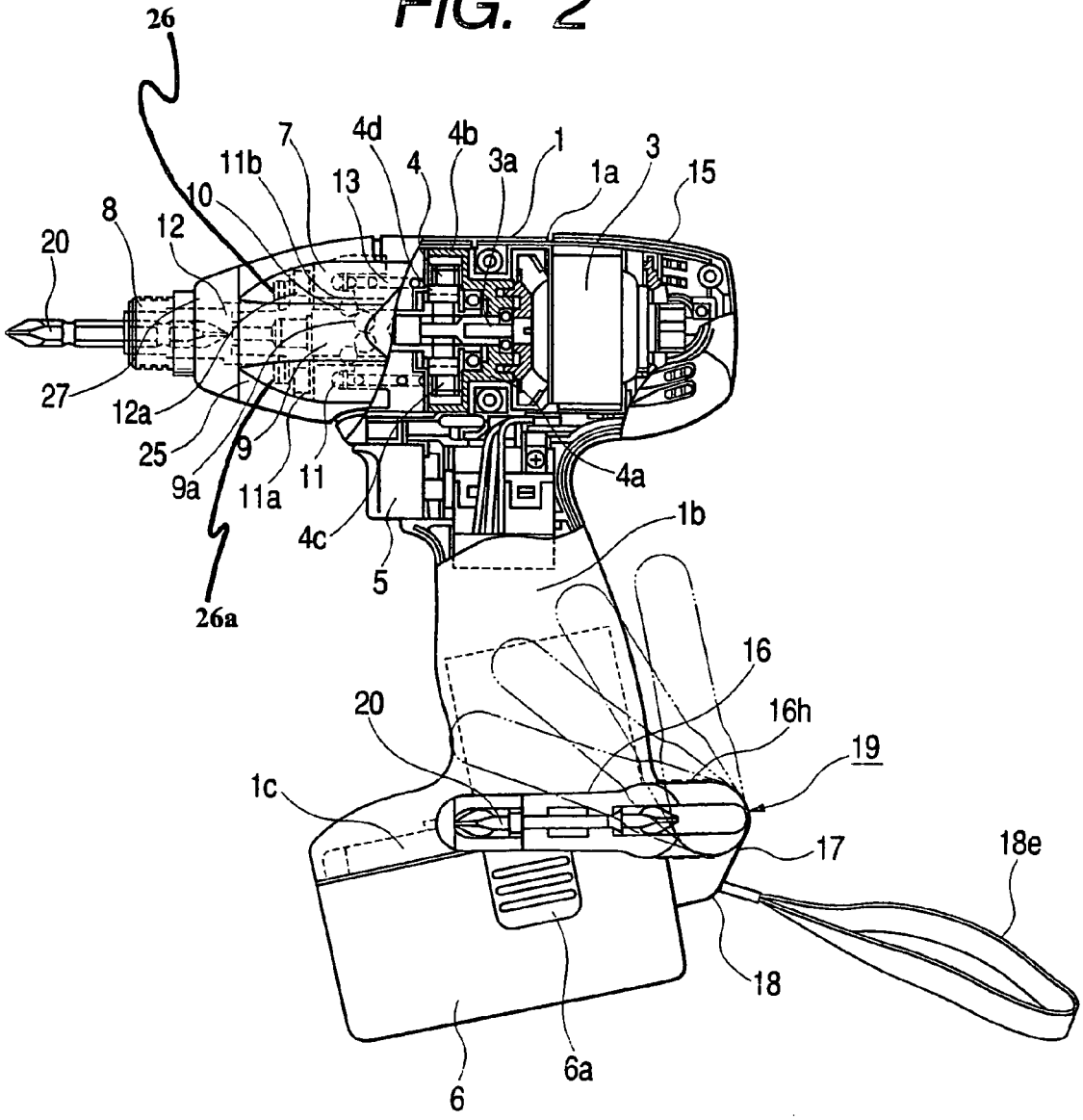
FIG. 2 is a side view, partly in longitudinal section, showing the electric power tool of the invention.

Referring to FIGS. 1 and 2, the electric power tool has an outer frame configured by a two-piece housing 1, the hammer case 2, and so forth, and is formed into an approximately T-like shape. A body portion 1*a* formed by the housing 1 houses a motor 3 serving as a driving source, a reduction mechanism 4, etc. A handle 1*b* which hangs from the body portion 1*a* houses a trigger switch 5, and contacts (not shown) which are to be electrically connected to terminals of a storage battery 6. The hammer case 2 is placed adjacent to the housing 1, and houses: a percussion mechanism 7 which converts the rotative power from the motor 3 into a percussive force; and a holder 8 for a tool bit such as a bit or a wrench which is not shown. According to the configuration, the rotative power from the motor 3 is transmitted to the reduction mechanism 4 from a pinion 3*a* which is an output shaft of the motor 3, and then to the tool bit from the reduction mechanism 4 via the percussion mechanism 7.

The reduction mechanism 4 is configured by: a stationary-gear support jig 4*a* which is supported in the housing 1, and which has a rotation stop; a stationary gear 4*b*; planetary gears 4*c*; a spindle 9; and needle pins 4*d* serving as rotation shafts of the planetary gears 4*c* and supported on the spindle 9. The percussion mechanism 7 is configured by: the spindle 9; a hammer 11 which are made rotatable and movable along the axis of the rotation shaft via steel balls 10 that are inserted into a cam groove 9*a* formed in the spindle 9; an anvil 12 having anvil claws 12*a* which are struck by a plurality of hammer claws 11*a* disposed on the hammer 11 to be rotated; and a spring 13 which always urges the hammer 11 toward the anvil 12.

In the thus configured electric power tool, an impulsive impact which is to be applied to a screw, a nut, or the like that is to be tightened by the tool bit is generated in the following manner. The trigger switch 5 is operated to supply an electric power to the motor 3, thereby rotating the motor 3. Thereafter, the rotative power from the motor 3 is transmitted to the planetary gears 4*c* via the pinion 3*a* which is coupled to the front end of the motor 3, and the rotative power from the pinion 3*a* is transmitted to the spindle 9 via the needle pins 4*d* by means of meshing between the planetary gears 4*c* and the stationary gear 4*b*. The turning force of the spindle 9 is transmitted to the hammer 11 via the steel balls 10 which are arranged between the cam groove 9*a* of the spindle 9 and a cam groove 11*b* of the hammer 11. The hammer claws 11*a* of the hammer 11 which is urged to the front side (toward the bit) by the spring 13 placed between the hammer 11 and the planetary gears 4*c* of the spindle 9 are caused to strike the anvil claws 12*a* of the anvil 12 by the rotation, so that the impact is generated. When the striking energy of the hammer 11 is reduced after the striking and the torque of the anvil 12 is reduced, the hammer 11 is repelled from the anvil 12, and hence the hammer 11 moves (retracts) along the cam groove toward the planetary gears 4*c*. Thereafter, the hammer 11 is pushed back toward the anvil 12 along the cam groove by the compressive force of the spring 13, and the hammer claws 11*a* again strike the anvil claws 12*a* by the rotation of the spindle 9. In this way, a continuous impact torque is applied to the tool bit such as a bit or a wrench by repeatedly conducting the striking against the anvil claws 12*a* by the axial movement and rotation of the hammer 11, so that a work of fastening a screw or a nut onto a work member 14, or that of loosening a screw or a nut from the work member 14 can be conducted.

An elastomer 15 is applied by two-layer molding to the surface of the housing 1 of the electric power tool having the percussion mechanism 7 and the reduction mechanism 4 which have been described above, specifically, on the rear face of the body portion 1*a* of the housing 1 and the handle 1*b*. The purposes of application of the elastomer 15 are to improve an antislipping function of surely gripping the electric power tool or a grip feeling, thereby enhancing the operability and the workability, to absorb an impact when the electric power tool is dropped on the ground, thereby preventing the tool from being damaged, and to, when the electric power tool is placed on an inclined face, prevent the tool from slipping down along the inclination. In order to enhance the effects of preventing the electric power tool from being damaged and of antislipping, the elastomer 15 may be applied to the periphery of a battery holder 1*c*.

As shown in FIGS. 1 to 4, in order to enable the body of the electric power tool to be hooked to a waist belt or the like of a worker, the electric power tool is provided with a rotatable hook portion 19 configured by an engagement member 16, a holding portion 17, and a strap portion 18 which will be described below.

The hook portion 19 comprises: the engagement member 16 which can house a tool bit 20 such as a bit, and which has a substantially cylindrical basal end 16*a* made of a resin; the holding portion 17 which has a through hole 17*a* that can house the basal end 16*a* of the engagement member 16, and which extends from the handle 1*b* to a position adjacent to a side face of the storage battery 6; a bolt 21 serving as a fixing member which is passed through the holding portion 17, and which is screwed with a nut 16*b* serving as a locking member disposed in the basal end 16*a*, to prevent the engagement member 16 from slipping off from the holding portion 17; and an elastic member 22 formed by a spring or elastic rubber which urges the engagement member 16 in a direction along which the engagement member is locked to a nonrotatable position. In the basal end 16*a* of the engagement member 16 having a substantially L-like shape, disposed are: a cylindrical rotation tube 16*c* which uses a pivotal axis 23 as a rotation axis; an angle adjusting gear 16*d* which is formed on the rotation tube 16*c*, which protrudes in the direction of the pivotal axis 23, and which has a plurality of teeth that project radially outward with respect to the pivotal axis 23; a first ring portion 16*e* which protrudes so as to have a diameter that is substantially equal to the inner diameter of the angle adjusting gear 16*d*; and a second ring portion 16*f* having a diameter that is equal to or smaller than the outer diameter of the first ring portion 16*e*. In the basal end 16*a*, a nut housing portion 16*g* which has a half-hexagonal wall shape, and which nonrotatably houses the nut 16*b* that is to be screwed with the bolt 21 passed into the basal end from the side of the second ring portion 16*f* is disposed, and the through hole (bolt hole) 17*a* for housing the bolt 21 is disposed in the direction of the pivotal axis 23 in the range from the nut housing portion 16*g* to the second ring portion 16*f*. A step portion 16*i* for forming an outer diameter which is larger than the outer diameter of the rotation tube 16*c* is disposed on the end face of the rotation tube 16*c* which is positioned on the side opposite to the angle adjusting gear 16*d*, i.e., a rising protruding portion of the rotation tube 16*c* in the engagement member 16 having an antislipping portion 16*h*. A rotation inhibiting plate 16*j* which restricts the turning range of the engagement member 16 protrudes from the outer periphery of the rotation tube 16*c*.

On the other hand, the holding portion 17 is symmetrical about the split plane of the housing 1, and has the through hole (cylindrical hole) 17*a* in which the basal end 16*a* is to be housed. The through hole 17*a* is configured by: a rotation support hole 17*b* which houses the rotation tube 16*c*; a ring gear 17*c* which has a plurality of teeth, and which can mesh with the angle adjusting gear 16*d*; and a receiving hole 17*d* which houses a hooking spring 22 disposed between the ring gear 17*c* and the bolt 21 having a slotted head (bolt head) 21*a*, and the bolt head 21*a*. A rotation inhibiting plate receiving groove 17*e* which abuts against the rotation inhibiting plate 16*j* in order to restrict the turning range of the engagement member 16 to a predetermined angle range is formed in the rotation support hole 17*b*.

The strap portion 18 is disposed below the holding portion 17 and configured by: a strap screw 18*a* which is in parallel to the axial length of the basal end 16*a* that is passed through the through hole 17*a*; a through hole 18*b* through which the strap screw 18*a* is to be passed; and a strap nut 18*c* which is to be screwed with the strap screw 18*a* so as to prevent the strap screw 18*a* from slipping off from the through hole 18*b*. A cutaway portion 18*d* through which the strap screw 18*a* is exposed is formed in a part of the strap portion 18. A ring portion 18*f* which is formed in one end of a strap 18*e* is passed through the cutaway portion 18*d*. Thereafter, the strap screw 18*a* is passed into the ring portion 18*f* and then screwed with the strap nut 18*c*, thereby enabling the strap 18*e* to be hooked on the shaft of the strap screw 18*a*. Since the strap portion 18 is disposed below the holding portion 17 as described above, the engagement member 16 which is detachably disposed on the holding portion 17 is placed adjacent to a cover portion (skirt portion) 1*c* which houses a part of the storage battery 6. During a process of operating an operating portion (latch) 6*a* of the storage battery in which an attaching or detaching work is conducted on the handle 1*b*, therefore, the engagement member 16 does not obstruct the operation, and hence the user can easily attach or detach the storage battery 6.

Next, the methods of attaching and detaching the engagement member 16 to and from the holding portion 17 of the housing 1 will be described. In the state where the nut 16*b* is inserted into the nut housing portion 16*g*, first, the engagement member 16 is passed through the through hole 17*a* of the holding portion 17, the hooking spring 22 is passed into the receiving hole 17*d* along the second ring portion 16*f*, and a thread portion 21*b* disposed on the front end of the bolt 21 is screwed with a thread portion 16*k* formed inside the nut 16*b*, whereby the engagement member 16 can be attached to the holding portion 17 via the hooking spring 22. The engagement member 16 can be easily detached from the holding portion 17 of the housing 1 by conducting the above-mentioned procedure in the reverse sequence. As described above, the holding portion 17 is symmetrical about the split plane of the housing 1, and the engagement member 16 which can house the tool bit 20 such as a bit has a substantially linear shape. In accordance with, for example, the handedness of the worker, therefore, the engagement member 16 can be inserted into and attached to either of the right and left sides of the holding portion 17. Even when the engagement member 16 is attached to either of the sides, the engagement member can be placed adjacent to the vicinity of the cover portion 1*c* which houses a part of the storage battery 6. Therefore, the engagement member 16 is placed in a position where, during a process of operating the operating portion 6*a* of the storage battery 6 in which an attaching or detaching work is conducted on the handle 1*b*, the engagement member 16 does not obstruct the operation, and hence the user can easily attach or detach the storage battery 6, so that the workability and the operability can be improved.

As described above, the embodiment has a shape in which the engagement member 16 can be attached to either of the right and left sides of the holding portion 17 without causing any difficulty. In order to prevent the engagement member 16 from obstructing an operation on the operating portion 6*a* of the storage battery 6, the engagement member 16 may have a bent shape in place of the substantially linear shape. In this configuration, in the cases where the engagement member 16 is inserted from the left side of the holding portion 17, and where the engagement member 16 is inserted from the right side of the holding portion 17, the vertical relationship of the engagement member 16 is inverted. Therefore, there arises a case where the engagement member 16 is positioned above the operating portion 6*a* of the storage battery 6. When the engagement member 16 is to be replaced with another one as required, therefore, it is necessary to separately prepare dedicated engagement members such as an engagement member for the left side, and that for the right side. This impairs the ease of use, and increases the economic burden on the user.

Next, an operation of turning the engagement member 16 will be described with reference to FIGS. 2 to 4. FIGS. 2 and 3 show a state where the engagement member 16 is positioned and fixed in a position adjacent to the cover portion (skirt portion) 1*c* which houses a part of the storage battery 6. The engagement member 16 is configured so that the pressure of the hooking spring 22 is applied in the direction of pushing out the bolt head 21*a* with using a spring receiving end face 16*l* in the holding portion as a fulcrum, and the step portion 16*i* is supported with abutting against an end face 17*f* of the holding portion 17, whereby the member is prevented from being separated, and also that the angle adjusting gear 16*d* is held in the meshing state with the ring gear 17*c*, and hence the pivotal axis 23 of the basal end 16*a* is prevented from being rotated in the circumferential direction, whereby stabilized positioning and fixation can be attained. In the embodiment, the position where the engagement member 16 is positioned adjacent to the vicinity of the cover portion 1*c* housing a part of the storage battery 6 is one of positions where the end face of the rotation inhibiting plate 16*j* abuts against that of the rotation inhibiting plate receiving groove 17*e*. Therefore, the engagement member 16 can be turned to the position.

In this state, the engagement member 16 is turned in the following manner. As shown in FIGS. 2 and 4, when the antislipping portion 16*h* of the engagement member 16 is nipped by the fingers and then pulled in the direction of the pivotal axis 23 (the upward direction in the figure), the meshing between the angle adjusting gear 16*d* of the basal end 16*a* and the ring gear 17*c* is cancelled. Therefore, the engagement member 16 can be turned within the predetermined angle range. When the engagement member 16 is released at an arbitrary position, the angle adjusting gear 16*d* and the ring gear 17*c* are caused to mesh with each other by the elastic force of the hooking spring 22, and the engagement member can be positioned and fixed.

The engagement member 16 in the embodiment attains an effect that positioning and fixation can be conducted in an arbitrary position by the simple configuration and method, and has great versatility to be used in a wide variety of portable tools, in addition to an exemplified impact driver/impact wrench, such as a circular saw, a drill, a disk grinder, a driver, a hammer, a hammer drill, a jigsaw, a cutter, a saber saw, an air tool, and a nailing machine.

Figure 15:
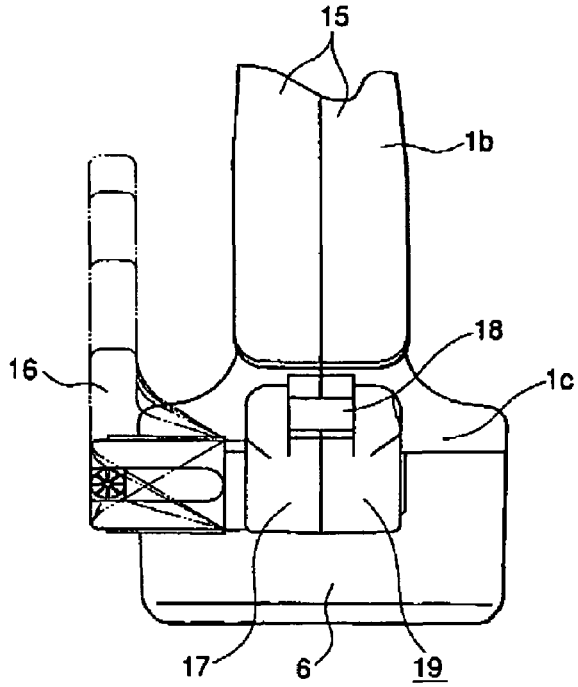
[RELATED ART] FIG. 15
FIG. 15 is a side view, partly omitted, of a hook portion of the conventional electric power tool as looking from the right side of FIG. 14.
Figure 16:
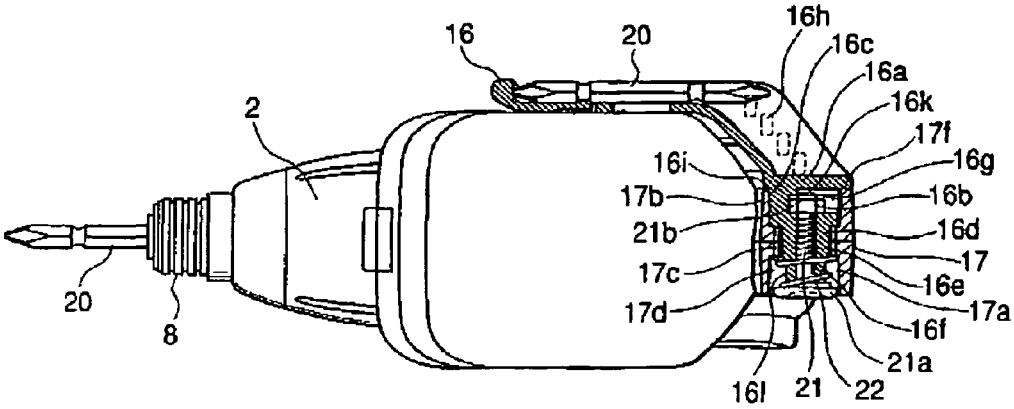
[RELATED ART] FIG. 16
FIG. 16 is a fragmentary section view of the conventional electric power tool as looking from the battery side of FIG. 14.
Figure 19:
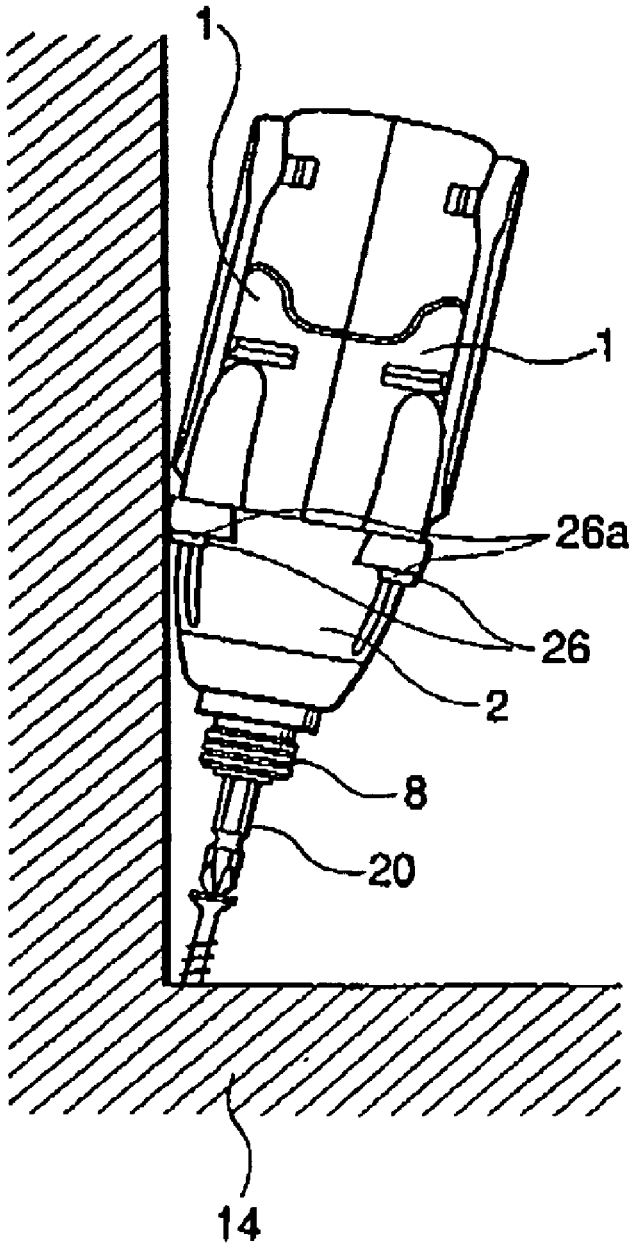
[RELATED ART] FIG. 19
FIG. 19 is a diagram showing another use state of the conventional electric power tool.

Next, the cover 25 which is made of a resin, and which is detachably attached to the outer periphery of the hammer case 2 housing the percussion mechanism 7 of the electric power tool will be described with reference to FIGS. 5 to 10. FIG. 5 is an external perspective view of the cover 25. As shown in FIG. 1, the cover is used with being attached to the outer periphery of the hammer case 2 made of metal such as aluminum or magnesium. The hammer case 2 is integrally fastened and fixed to the housing 1 with using a plurality of fastening screws 26. The heads 26*a* of the fastening screws 26 are exposed to the appearance of the electric power tool. In the case where the work shown in FIG. 15 is conducted in the state where the heads are exposed as described above, the fastening screws 26 are in contact with the work member 14, thereby causing a problem in that the work member 14 is damaged.

In the embodiment, therefore, the heads 26*a* of the fastening screws 26 are covered as shown in FIG. 1 by the cover 25 made of an elastic material (resin or rubber) which is lower in hardness than the material (metal) of the fastening screws 26, or which is softer, thereby preventing the heads 26*a* of the fastening screws 26 from being exposed. The cover 25 is surely positioned by the stopper (resin or elastic rubber) serving as a fixing unit shown in FIGS. 6 and 7 so that the cover 25 is not separated from the hammer case 2 toward the tool bit by impulsive vibration generated during the use of the electric power tool. As shown in FIG. 8, the attachment state by means of the cover 25 and the stopper 27 can be surely conducted by engaging fitting projections 2*a* formed on the hammer case 2 with fitting recesses 27*a* shown in FIGS. 6 and 7 and formed inside the stopper. According to the configuration, the cover 25 is in contact with the work member 14 as shown in FIGS. 9 and 10, and hence it is possible to solve the above-discussed problem. The fitting projections 2*a* and the fitting recesses 27*a* may be formed in a reversed manner.

An inclination (taper) 25*b* is formed in a front end portion of each of plural protrusions 25*a* which are disposed along the longitudinal direction of the cover 25 in order to respectively house the fastening screws 26. Even when an external member is in contact with one of the protrusions 25*a*, therefore, a shock can be moderated along the inclination 25*b*, i.e., it is possible to allow the member to escape along the inclination 25*b*. Therefore, the ease of use is improved, and the cover 25 can be prevented as far as possible from receiving damage, etc. Depending on the kind of a work, the user sometimes conducts the work while gripping the outer periphery of the hammer case 2. In such a case, when the hammer case 2 is heated by the heat which is generated during a process of striking the anvil claws 12*a* by the hammer claws 11*a*, it is difficult to grip the hammer case 2, whereby the workability and the operability are lowered. In the embodiment, since the cover 25 is disposed on the outer periphery of the hammer case 2, the influence of heat on the work can be reduced, so that an electric power tool having excellent ease of use can be provided.

The case where the hammer case 2 made of aluminum or magnesium is gripped, and that where the cover 25 in the embodiment is gripped will be compared with each other. In the case where the hammer case 2 is gripped, slippage occurs more easily from the view point of a frictional force, and, particularly when the hands of the user are wet with perspiration or water, slippage easily occurs. Consequently, a disadvantage that a work cannot be stably conducted is caused. By contrast, in the case where the cover 25 is gripped, slippage occurs more hardly than the case where the hammer case 2 made of aluminum or magnesium is gripped, and hence a work can be stably conducted.

In an electric power tool in which the cover 25 is not provided or the hammer case 2 is exposed, coating is applied in order to improve the appearance of the hammer case 2. In the embodiment, since the hammer case 2 is not exposed as a result of the disposition of the cover 25 on the outer periphery of the hammer case 2, it is not necessary to consider the appearance of the hammer case 2, and hence the cost and labor required for coating can be eliminated, with the result that an economical electric power tool can be provided.

As modifications of the cover 25, the cover may have the shapes of the covers 25' and 25" shown in FIGS. 11 and 12. The cover 25' has a shape in which a rear portion (the portion on the side opposite to the tool bit) of the cover 25 is cut away, and which covers the outer peripheries of the fastening screws. The cover 25" has a shape in which a front portion (the portion on the side of the tool bit) of the cover 25 is cut away, and which similarly covers the outer peripheries of the fastening screws. As described above, the shape of the cover 25 is not restricted to that of the embodiment and may have any shape as far as it can cover the outer peripheries of the heads 26*a* of the fastening screws 26.

According to the invention, a cover which covers outer peripheries of fastening screws is disposed on an outer periphery of a hammer case, whereby an electric power tool which can prevent a work member from being damaged, which is excellent in workability and operability, and which is economical can be provided.

What is claimed is:

1. A power tool, comprising:

a motor as a driving force; and a housing holding the motor:

a tool bit holder provided on the front end of the housing;

a handle section extending below from the housing;

a battery being attached to one end of the handle section, said battery having a front surface facing toward the tool bit holder and extending substantially perpendicular to the tool bit holder, and a side surface disposed on the side of the front surface and extending substantially parallel to the tool bit holder;

an operation section provided on the side surface of the battery to attach and detach the battery to and from the handle section;

a hook portion comprising a holding portion formed by the housing and having a through hole, and an engagement member, an end of said engagement member being inserted in the through hole, wherein the engagement member and the through hole include angle adjustment members to fix the engagement member at a first position adjacent to a skirt portion of the housing which houses a part of the battery, and the engagement member is provided at a periphery of the operation section, so that the engagement member does not obstruct an operation of the operation section of the battery, wherein said hook portion is formed above a backside of said battery and said operation section is formed on a side of said battery that faces a direction that is substantially perpendicular to said backside, wherein the power tool further comprises a strap portion, said strap portion being disposed below the holding portion, and wherein a center axis of the strap portion is positioned below a center axis of the through hole.

2. The power tool according to claim 1, wherein the engagement member is rotatably inserted in the hole of the holding portion.

3. The power tool according to claim 1, where the engagement member is fixed at the first position adjacent to the skirt portion of the housing and at a second position at which the engagement member is rotated from the first position.

4. The power tool according to claim 1, wherein the engagement member includes a first section extending along a first side face of the housing and a second section extending along a second face of the housing.

5. The power tool according to claim 1, wherein the engagement member is provided above the operation section when the engagement member is fixed at the first position.

6. The power tool according to claim 5, wherein the engagement member is rotatable from the first position to an upper direction but not rotatable from the first position to a lower direction.

7. The power tool according to claim 5, wherein the engagement member is rotatable from the first position to an upper direction but not rotatable from the first position to a lower direction.

8. The power tool according to claim 1, wherein the strap portion includes a strap screw, wherein the holding portion includes a bolt, and wherein the strap screw is disposed below the bolt.

9. The power tool according to claim 8, wherein the strap portion comprises a strap, said strap configured to be hooked onto a shaft of the strap screw.

10. A power tool, comprising:

a housing;

a handle section extending below from the housing;

a battery being attached to one end of the handle section, said battery having a front surface facing toward a tool bit holder and extending substantially perpendicular to the tool bit holder, and a side surface disposed on the side of the front surface and extending substantially parallel to the tool bit holder;

an operation section provided on the side surface of the battery to attach and detach the battery to and from the handle section; and a hook portion formed above a backside of said battery, the hook portion including a holding portion having a through hole;

wherein said operation section is formed on a side of said battery that faces a direction that is substantially perpendicular to said backside of said battery, wherein the power tool further comprises a strap portion, said strap portion being disposed below the holding portion, and wherein a center axis of the strap portion is positioned below a center axis of the through hole.

11. The power tool according to claim 10, further comprising an engagement rotatably inserted in a hole in the holding portion.

12. The power tool according to claim 11, where the engagement member is fixed at the first position adjacent to a skirt portion of the housing and at a second position at which the engagement member is rotated from the first position.

13. The power tool according to claim 11, wherein the engagement member includes a first section extending along a first side face of the housing and a second section extending along a second face of the housing.

14. The power tool according to claim 11, wherein the engagement member is provided above the operation section when the engagement member is fixed at the first position.

15. The power tool according to claim 10, wherein the strap portion includes a strap screw, wherein the holding portion includes a bolt, and wherein the strap screw is disposed below the bolt.

16. The power tool according to claim 15, wherein the strap portion comprises a strap, said strap configured to be hooked onto a shaft of the strap screw.

* * * * *